US005662043A

United States Patent [19]

Fischer et al.

[11] Patent Number: 5,662,043

[45] Date of Patent: Sep. 2, 1997

[54] METHOD FOR MOUNTING A METERING DEVICE

[75] Inventors: Christian Martin Michael Fischer, Marktheidenfeld; Josef Höfling, Gemünden; Helmut Holm, Erlabrunn, all of Germany

[73] Assignee: Koenig & Bauer-Albert Aktiengesellschaft, Germany

[21] Appl. No.: 679,249

[22] Filed: Jul. 12, 1996

[30] Foreign Application Priority Data

Jul. 13, 1995 [DE] Germany ..... 195 25 529.1

[51] Int. Cl.[6] ..... B41F 31/04

[52] U.S. Cl. ..... 101/487; 101/365

[58] Field of Search ..... 101/487, 365

[56] References Cited

U.S. PATENT DOCUMENTS

| | | | |
|---|---|---|---|
| 4,495,864 | 1/1985 | Junghans | 101/365 |
| 4,502,386 | 3/1985 | Cappel et al. | 101/350 |
| 5,046,420 | 9/1991 | Sondergeld et al. | 101/350 |
| 5,438,927 | 8/1995 | Banike et al. | 101/365 |

FOREIGN PATENT DOCUMENTS

| | | |
|---|---|---|
| 376885 | 12/1989 | European Pat. Off. . |
| 39 25 034 | 8/1990 | Germany . |
| 42 40 642 | 6/1994 | Germany . |

*Primary Examiner*—Edgar S. Burr
*Assistant Examiner*—Leslie Grohusky
*Attorney, Agent, or Firm*—Jones, Tullar & Cooper, P.C.

[57] ABSTRACT

A plurality of inking blade plates are positioned in abutting fashion between cooperating insertion and clamping strips to form an inking blade. A temperature differential is created between the blade plates and the strips which are then allowed to return to a common temperature. This creates a uniform spacing between each of the inking blade plates in the inking blade. The resulting inking blade is usable with an ink ductor roller in a rotary printing press.

5 Claims, 3 Drawing Sheets

4

METHOD FOR MOUNTING A METERING DEVICE

FIELD OF THE INVENTION

The present invention is directed generally to a method for mounting a metering device. More specifically, the present invention is directed to a method for mounting a metering device in a rotary printing press. Most particularly, the present invention is directed to a method for mounting a metering device, that is comprised of a plurality of inking blade plates, in a rotary printing press. The plurality of inking blade plates are disposed adjacent each other in an accurately longitudinally spaced manner and are fastened on an insertion strip. This insertion strip is placed in an ink application device. The plurality of inking blade plates are also individually adjustable so that their individual contacts with an ink duct roller can be adjusted.

DESCRIPTION OF THE PRIOR ART

It is generally known in the art to provide metering devices in rotary printing presses, with these metering devices typically being used to control the application of a fluid, such as ink, to the surface of a roller. The roller may be an ink ductor roller that dips into an ink reservoir in an ink application device. The metering device typically includes a blade or a plurality of blades which are usable to control or meter the thickness of the layer or film of ink that is carried by the ink ductor roller out of the ink reservoir.

One metering device for a rotary printing press is described in the German Patent Publication No. DE 42 40 642 A1. In this device, a plurality of inking blade plates are fastened on an insertion strip. Each of these inking blade plates are disposed or situated on the insertion strip at a small distance from each other. In this prior art device, it has been difficult to accurately position and attach the inking blade plates adjacent each other on the insertion strip. It has also been a tedious and time consuming job to accomplish this fastening of the inking blade plates to the insertion strip.

It will be seen that a need exists for a metering blade mounting method which overcomes these limitations of the prior art. The method for mounting a metering device in a rotary printing press in accordance with the present invention overcomes these limitations and is a significant improvement over the prior art.

SUMMARY OF THE INVENTION

It is an object of the present invention to provide a method for mounting a metering device.

Another object of the present invention is to provide a method for mounting a metering device in a rotary printing press.

A further object of the present invention is to provide a method for mounting a metering device, including a plurality of inking blade plates, in a rotary printing press.

Still another object of the present invention is to provide a method of mounting an inking blade, which cooperates with an ink ductor roller, in a rotary printing press.

Yet a further object of the present invention is to provide a method for mounting an inking blade which consists of a plurality of inking blade plates and in which a small parallel longitudinal spacing distance is formed between each of the adjacent inking blade plates.

As will be discussed in detail in the description of the preferred embodiment which is presented subsequently, the method for mounting a metering device in a rotary printing press in accordance with the present invention utilizes a plurality of inking blade plates, which are disposed adjacent each other on an insertion strip, to form the metering device. The plurality of inking blade plates are placed on the insertion strip and a positive temperature differential is created in the inking blade plates with respect to the insertion strip. The blade plates are loosely fastened on the insertion strip while this positive temperature differential exists. Once the temperatures of the blade plates and the insertion strip arrive at equilibrium, the small parallel longitudinal spacing gaps between the adjacent ones of the inking blade plates will have been formed.

A particular advantage of the method for mounting a metering device in accordance with the present invention is that a distance between the respective ink blade plates which are attached to the insertion strip in accordance with the present method can be set very accurately. The blades can be accurately positioned even in the range of a thousandth of a millimeter. The deviations of the distances between the various inking blade plates attached to the insertion strip are extremely small.

Another particular advantage of the method for mounting a metering device in accordance with the present invention resides in the savings of time that result from the use of the subject method. This reduction of time is accomplished with no reduction in spacing accuracy. In fact, the method of mounting a metering device in accordance with the present invention provides both reduced amounts of time required to accomplish the mounting of the inking blade plates, together with a simultaneous increase in accuracy in obtaining the desired plate spacing distances.

The method for mounting a metering device in a rotary printing press, in accordance with the present invention, overcomes the limitations of the prior art. It is a substantial advance in the art.

BRIEF DESCRIPTION OF THE DRAWINGS

While the novel features of the method for mounting a metering device in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
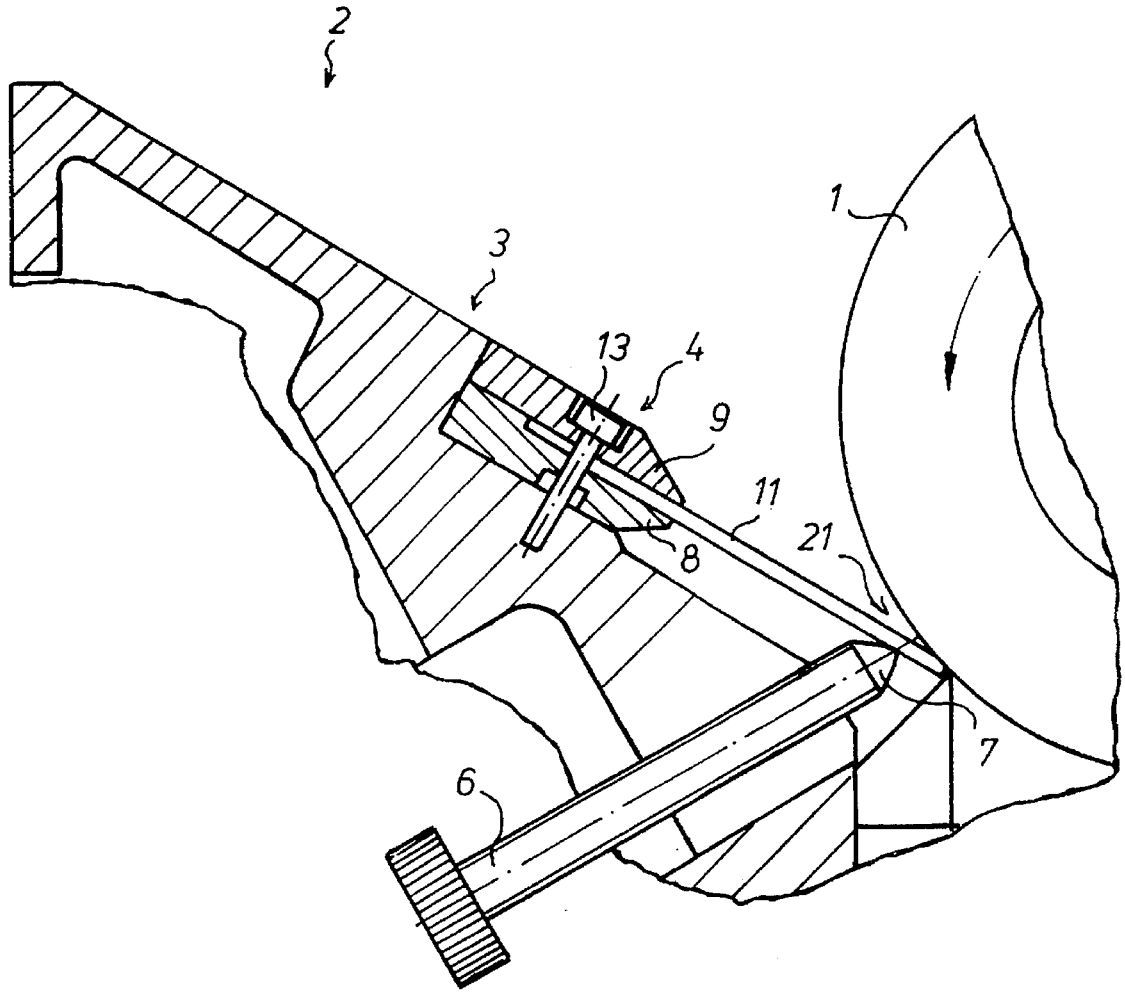
FIG. 1 is a schematic cross-sectional view through an ink application device in accordance with the present invention.

Turning initially to FIG. 1, there may be seen, generally at 2, an ink application device that utilizes a metering device which is made in accordance with the present invention. This ink application device 2 cooperates with an ink ductor 1 of a rotary printing press. This ink application device 2 is shown in a simplified form and essentially consists of an ink reservoir 3, an inking blade 4, and adjustment devices 6 acting on the inking blade 4. In the depicted preferred embodiment, the adjustment devices 6 are embodied as threaded screws 6 which are movable in the ink reservoir 3 and whose respective ends 7, disposed in the interior of the ink reservoir 3, act on the inking blade 4 in the area of the ink ductor 1.

The inking blade 4 extends longitudinally parallel with the axis of rotation of the ink ductor 1, and the length of the inking blade 4 corresponds to the length of the ink reservoir 3. The inking blade 4 essentially consists of an insertion strip 8, a cooperating clamping strip 9, and a plurality of inking blade plates 11. The insertion strip 8 and the clamping strip 9 are connected with each other by means of a plurality of longitudinally spaced, threaded connection screws 12, as may be seen more particularly in FIGS. 2 and 3. In the connected state the insertion strip 8 and the clamping strip 9 are cuboid in overall shape with a length 18, for example 18 =350 mm, and a thickness d8, for example d8 =30 mm. The inking blade 4 is fastened, by means of threaded fastening screws 13, in the ink reservoir 3 as is shown in FIG. 1. As may be seen in FIG. 3, the fastening screws 13 are interposed between the connecting screws 12 along the longitudinal length of the insertion strip 8 and the clamping strip 9.

Figure 2:
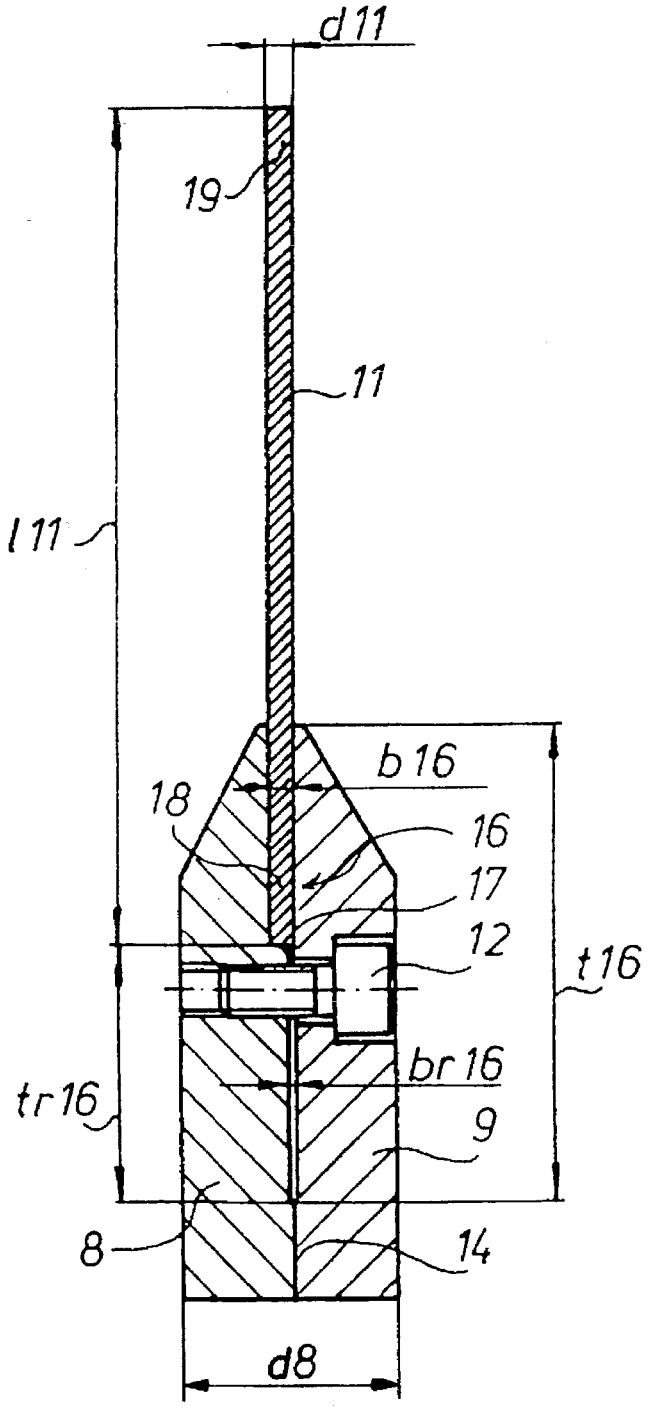
FIG. 2 is a cross-sectional view through an inking blade.

To receive the individual inking blade plates 11, the insertion strip 8 and the clamping strip 9 are embodied, parallel with their common contact face 14, offset in such a way that in the connected state as depicted in FIG. 2, an axis-parallel gap 16 of a first, outer width b16 and a second, inner, reduced width br16 and which extends over the entire length 14 of the inking blade 4, results. This gap 16 extends into the insertion strip 8 and the clamping strip 9 from an outer end of the strips 8 and 9 facing the ink ductor 1, to an overall depth t16. Intermediate the outer end of the strips 8 and 9 and the bottom of gap 16 the width b16 of this gap 16 is reduced to the reduced width br16 with this reduced width br16 extending to a depth tr16. As a result of this reduction in width the gap 16 is provided with a contact face or shoulder 17 at the point where the gap width b16 is reduced to br16. The threaded screws 12 connecting the insertion and clamping strips 8, 9 are disposed in the area of the reduced gap 16, generally adjacent the contact face or shoulder 17.

Figure 3:
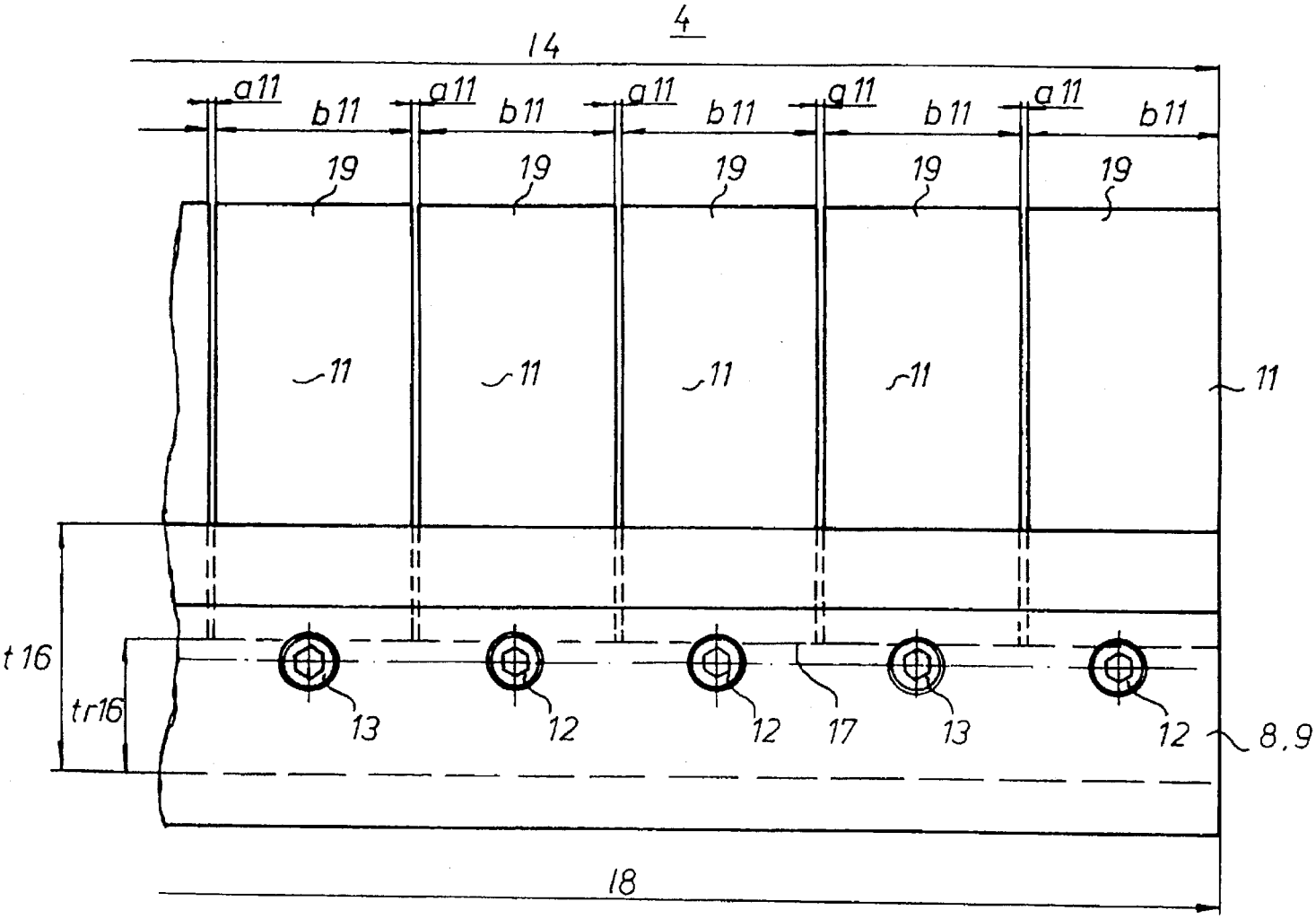
FIG. 3 is a schematic top plan view of an inking blade in accordance with the present invention.

Referring now primarily to FIGS. 2 and 3, it may be seen that the plurality of individual inking blade plates 11, which cooperate with the strips 8 and 9 to form the inking blade 4, are embodied as a plurality of similar rectangular plates, each of a width b11, for example b11 =40 mm, a length 111, for example 111 =80 mm and a thickness d11, for example d11 =2.5 mm. These plates 11 are made of spring steel, for example. The thickness d11 of the inking blade plates 11 is slightly greater than the width b16 of the wider portion of the gap 16 between the insertion and clamping strips 8, 9. In the fully mounted state, the inking blade plates 11 rest with their outboard ends 18; i.e. their ends 18 facing away from the ink ductor 1, against the contact face 17 which is formed by the gap 16 between the insertion and clamping strips 8, 9 where the gap width b16 is reduced to br16. These inking blade plates 11 are clamped in place between the insertion and clamping strips 8, 9. By means of their inboard ends 19 facing the ink ductor 1, the inking blade plates 11 form an adjustable gap 21 with the ink ductor 1. A separate adjustment device 6 is assigned to each ink blade plate 11. The ink blade plates 11 are disposed close to each other at a small longitudinal spacing distance all which, for example, is 1 to 10 μm. This distance all is intended to cause a reactionless movement of each of the inking blade plates 11 in respect to each other plate 11, but also to prevent the penetration of ink at the same time between the plates 11; i.e. to prevent the penetration of ink between the plates 11 through the plate spacing gaps.

In accordance with the present invention, the method for setting the spacing distance all between the adjacent inking blade plates 11 is accomplished in the following manner. The outboard ends 18 of all of the inking blade plates 11 are aligned between the insertion and clamping strips 8, 9 and in abutment with the contact face 17. These inking blade plates 11 are inserted without any longitudinal distance between them. Then the inking blade plates 11 are slightly or loosely clamped between the insertion and clamping strips 8, 9 by means of the threaded connection screws 12. The inking blade plates 11 of the inking blade 4 premounted in this manner are now heated to a temperature between 40° and 50° C. for example. Heating can be performed, for example, by means of a hot plate on which the inking blade plates 11 are placed or by a hot air blower directed on the inking blade plates 11. Because of the greatly differing thicknesses d11 and d8, respectively of the inking blade plates 11 and of the insertion and clamping strips 8 and 9, the desired temperature is achieved more rapidly in the inking blade plates 11 than in the insertion and clamping strips 8, 9. Therefore there is a temperature difference of, for example, 20° C. between the inking blade plates 11 and the insertion and clamping strips 8, 9. The temperature increase causes a volume increase of the heated elements. Because of this, the width b11 of each of the individual inking blade plates 11 increases. As a result of the temperature difference between the insertion and clamping strips 8, 9, on the one hand, and the inking blade plates 11 on the other, the linear or longitudinal extension based on the sum of the widths b11 of all of the inking blade plates 11 is greater than the linear or longitudinal extension of the length 18 of the insertion and clamping strips 8, 9 in the longitudinal direction. The inking blade plates 11 are displaced in relation to the insertion and clamping strips 8, 9 because of this different linear extension, wherein the inking blade plates 11 support each other and are still slightly clamped. Subsequently, the entire inking blade 4 cools and both the insertion and clamping strips 8, 9 and the inking blade plates 11 reach a common temperature, for example, the ambient temperature. Because of this, the increase of the width b11 of the inking blade plates 11 and the length 18 of the insertion and clamping strips 8, 9 is canceled. Since the inking blade plates 11 are loosely clamped between the insertion and clamping strips 8 and 9, the position of the respective inking blade plates 11 in relation to the insertion and clamping strips 8 and 9 is preserved. The parallel extending spacing distances all between the respective inking blade plates 11 are formed in this way. This distance all between each of the adjacent inking blade plates 11 formed in this way is a function of the temperature difference between the insertion and clamping strips 8, 9 and the inking blade plates 11, as well as a function of the linear extension coefficients of the materials of the insertion and clamping strips 8, 9 and of the inking blade plates 11. After cooling has taken place, the inking blade plates 11 are fixedly clamped in place between the insertion and clamping strips 8, 9 by means of further tightening the threaded screws 12.

In place of heating the inking blade plates 11, it is also possible to apply a temperature difference between the inking blade plates 11 and the insertion and clamping strips 8, 9 by cooling the insertion and clamping strips 8, 9. It is, of course, also possible to fasten the inking blade plates 11 on the insertion strip 8 in another way, for example by means of individual screws.

While a preferred embodiment of a method for mounting a metering device in accordance with the present invention has been set forth fully and completely hereinabove, it will be apparent to one of skill in the art that a number of changes in, for example, the type of printing press, the type of ink being used, the means for driving the ink ductor roller and the like could be made without departing from the true spirit and scope of the present invention which is accordingly to be limited only by the following claims.

What is claimed is:

1. A method for mounting a metering device in a rotary printing press including:

providing a plurality of individual inking blade plates each having a blade plate width and which can be individually adjustably placed against an ink ductor roller;

providing an insertion strip having a strip length and a strip gap which will receive said plurality of inking blade plates;

placing an end of each of said inking blade plates in said insertion strip gap;

applying a positive temperature differential between said ink blade plates and said insertion strip;

creating a first linear extension of said plurality of individual inking plates and a second linear extension of said insertion strip, in response to said positive temperature differential, said first linear extension being greater than said second linear extension;

allowing said ink blade plates and said insertion strip to return to a common temperature;

forming a longitudinal space between each of said inking blade plates in said insertion strip in response to said greater first linear extension; and fastening said plurality of individual inking blade plates in longitudinally spaced positions on said insertion strip.

2. The method of claim 1 further including providing said temperature differential as approximately 20° C.

3. The method of claim 1 further including providing said longitudinal space between each of said inking blade plates between 0.001 mm to 0.01 mm.

4. The method of claim 2 further including providing said longitudinal space between each of said inking blade plates between 0. 001 mm to 0.01 mm.

5. The method of claim 1 further including providing a clamping strip, using said clamping strip in cooperation with said insertion strip in placing said inking blade plates in said insertion strip, and applying said temperature differential between said clamping strip and said inking blade plates.

* * * * *